US009347264B2

(12) United States Patent
Mosier et al.

(10) Patent No.: US 9,347,264 B2
(45) Date of Patent: May 24, 2016

(54) LADDER STABILIZING APPARATUS FOR USE WITH FERROMAGNETIC SUPPORT

(71) Applicant: Ladder Safety Magnet, LLC, El Dorado, AR (US)

(72) Inventors: Tim Mosier, Hope, AR (US); John Hill, El Dorado, AR (US)

(73) Assignee: Ladder Safety Magnet, LLC, El Dorado, AR (US)

( * ) Notice: Subject to any disclaimer, the term of this patent is extended or adjusted under 35 U.S.C. 154(b) by 0 days.

(21) Appl. No.: 14/663,885

(22) Filed: Mar. 20, 2015

(65) Prior Publication Data

US 2015/0191976 A1 Jul. 9, 2015

Related U.S. Application Data

(63) Continuation-in-part of application No. 14/094,964, filed on Dec. 3, 2013, now Pat. No. 9,010,490, which is a continuation-in-part of application No. 13/155,703, filed on Jun. 8, 2011, now Pat. No. 8,616,335.

(51) Int. Cl.
*E06C 7/48* (2006.01)
*E06C 7/18* (2006.01)

(52) U.S. Cl.
CPC . *E06C 7/48* (2013.01); *E06C 7/188* (2013.01); *E06C 7/486* (2013.01)

(58) Field of Classification Search
CPC ..... E06C 7/48; E06C 7/786
See application file for complete search history.

(56) References Cited

U.S. PATENT DOCUMENTS

| | | | | |
|---|---|---|---|---|
| 2,978,215 | A * | 4/1961 | Victor Shanok et al. | 248/115 |
| 4,727,462 | A * | 2/1988 | Komonko | 362/398 |
| 5,165,641 | A * | 11/1992 | Southern | E06C 7/48 182/214 |
| 9,132,796 | B1 * | 9/2015 | Matthews | B60R 19/54 |
| 2009/0242328 | A1 * | 10/2009 | Cabrera | E06C 7/06 182/111 |
| 2011/0315476 | A1 * | 12/2011 | Clarkson | 182/107 |
| 2014/0166397 | A1 * | 6/2014 | Reynolds | 182/107 |
| 2014/0225385 | A1 * | 8/2014 | Millsap | E05C 17/025 292/288 |

FOREIGN PATENT DOCUMENTS

| | | | | |
|---|---|---|---|---|
| GB | 745837 | A * | 3/1956 | E06C 7/48 |

* cited by examiner

*Primary Examiner* — Alvin Chin-Shue

(57) ABSTRACT

An apparatus to secure a ladder to a ferromagnetic support such as an exposed ferromagnetic support comprises a pair of bracket clamping assemblies removably attached to a rung on a ladder. The brackets are pivotally bolted to magnet mounts, which each hold a permanent magnet that releasably holds the ladder in place against the support. The apparatus prevents the ladder from slipping, and further serves to hold the ladder at the proper angle for safe use. The apparatus finds particular application where exposed ferromagnetic metal beams are available in the workspace but tying a ladder for safety would be impractical.

4 Claims, 2 Drawing Sheets

LADDER STABILIZING APPARATUS FOR USE WITH FERROMAGNETIC SUPPORT

CROSS-REFERENCE TO RELATED APPLICATIONS

This application is a continuation-in-part of U.S. patent application Ser. No. 14/094,964, filed on Dec. 3, 2013, entitled "Ladder Stabilizing Apparatus," which was in turn a continuation-in-part of U.S. patent application Ser. No. 13/155,703, filed on Jun. 8, 2011, now U.S. Pat. No. 8,616,335, issued Dec. 31, 2013, and entitled "Ladder Securing Apparatus." Such applications are incorporated by reference in their entirety herein.

BACKGROUND

The field of the invention is ladder stabilization, and in particular to the stabilization of a ladder by securing it magnetically to a ferromagnetic support, such as but not limited to a metal beam.

Portable ladders, and in particular the leaning-type extension ladders usually constructed of aluminum or fiberglass, are well known in the art. Such ladders are commonly employed for many industrial applications where a worker much reach a relatively high area in order to perform, for example, construction, painting or various maintenance, inspection, or repair operations.

In order to prevent slippage and resulting injury due to a fall, it is a common safety practice to tie or otherwise secure the top of a portable leaning-type ladder to the adjacent surface during its use. Workplace safety regulations promulgated by the United States Department of Labor's Occupational Safety & Health Administration (OSHA) require that these ladders be secured when used in certain workplace applications. OSHA estimates that of the portable ladder falls that result in injury or death, 61% occur from ladders that were not properly secured at the top. It is not always practical, however, to tie or secure the ladder to an adjacent surface due to the nature of the surface itself. It may also be seen that tying or other common means to secure the top of a portable, leaning-type ladder to a surface requires that a worker reach the top of the ladder before the ladder may be secured in place. Thus the worker is at risk until the worker reaches the top of the ladder and is able to complete the operation of securing the ladder into position. The movements necessary for the worker to secure the ladder in place may themselves lead to a slippage of the ladder, thus creating a risk associated with the very act intended to increase the safety of the further use of the ladder.

Another important safety issue with respect to the use of portable ladders is ensuring that the ladder is positioned at the proper angle with respect to the surface upon which the ladder is placed. OSHA Regulation 1926.1053(b)(5)(i) requires that leaning-type ladders be angled when in use such that the horizontal distance from the top support to the foot of the ladder is approximately one-quarter of the working length of the ladder. The working length is the distance along the ladder between the foot and top support. This ideal angle that results, with the ladder making an angle of about 76° with the horizontal support surface, maximizes the inherent stability of the ladder against slippage. When a portable ladder is in use in the field, however, it may be very difficult to determine whether the ladder is in fact properly positioned prior to use. The ease with which these ladders may be placed into position and the difficulty of determining the proper angle may encourage poor safety habits, particularly when the worker using the ladder is engaged in a time-critical construction or maintenance operation.

It may be seen from the above discussion that an apparatus for stabilizing a portable ladder when there is no readily available surface to secure the top of the ladder in place would be highly desirable. A means of stabilizing the top of a portable ladder in place that does not require the worker to first climb the ladder would also be highly desirable. Finally, a simple, effective means of ensuring that the ladder is positioned at the optimum angle with respect to the surface upon which the ladder is placed would also be highly desirable. A device that combines these desired advantages would be of great benefit in improving the safety of using portable ladders in industry, particularly with respect to portable ladders used in locations where a tie-off at the top of the ladder is not practical.

References mentioned in this background section are not admitted to be prior art with respect to the present invention.

BRIEF SUMMARY OF THE INVENTION

The present invention is directed to an apparatus to secure a ladder in place to a ferromagnetic support, such supports including but not limited to metal beams that are a part of buildings and may be exposed either during construction or after completion. The invention does not require the worker to climb the ladder before securing the ladder in place, thus avoiding the risk of fall during the process of climbing and securing the ladder. The invention further ensures that the ladder is positioned at the appropriate OSHA-mandated angle to provide for safe use of the ladder without slippage. This is achieved by bracket clamping assemblies that connect to an appropriate rung of the ladder and that magnetically engage with the beam or other ferromagnetic surface at the appropriate angle.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENT(S)

Figure 1:
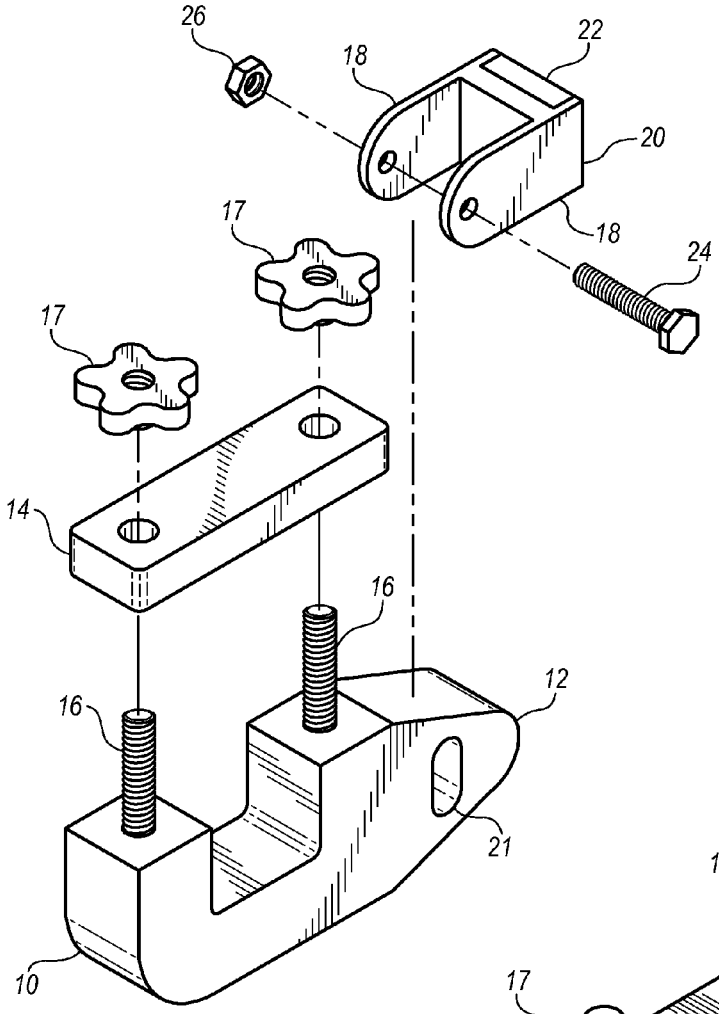
FIG. 1 is an exploded, perspective view of a bracket according to a preferred embodiment of the invention.
Figure 2:
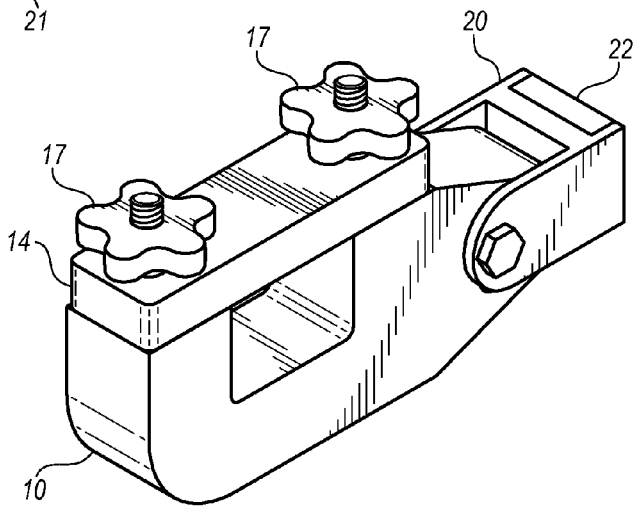
FIG. 2 is a perspective view in assembled form of a bracket according to a preferred embodiment of the invention.
Figure 3:
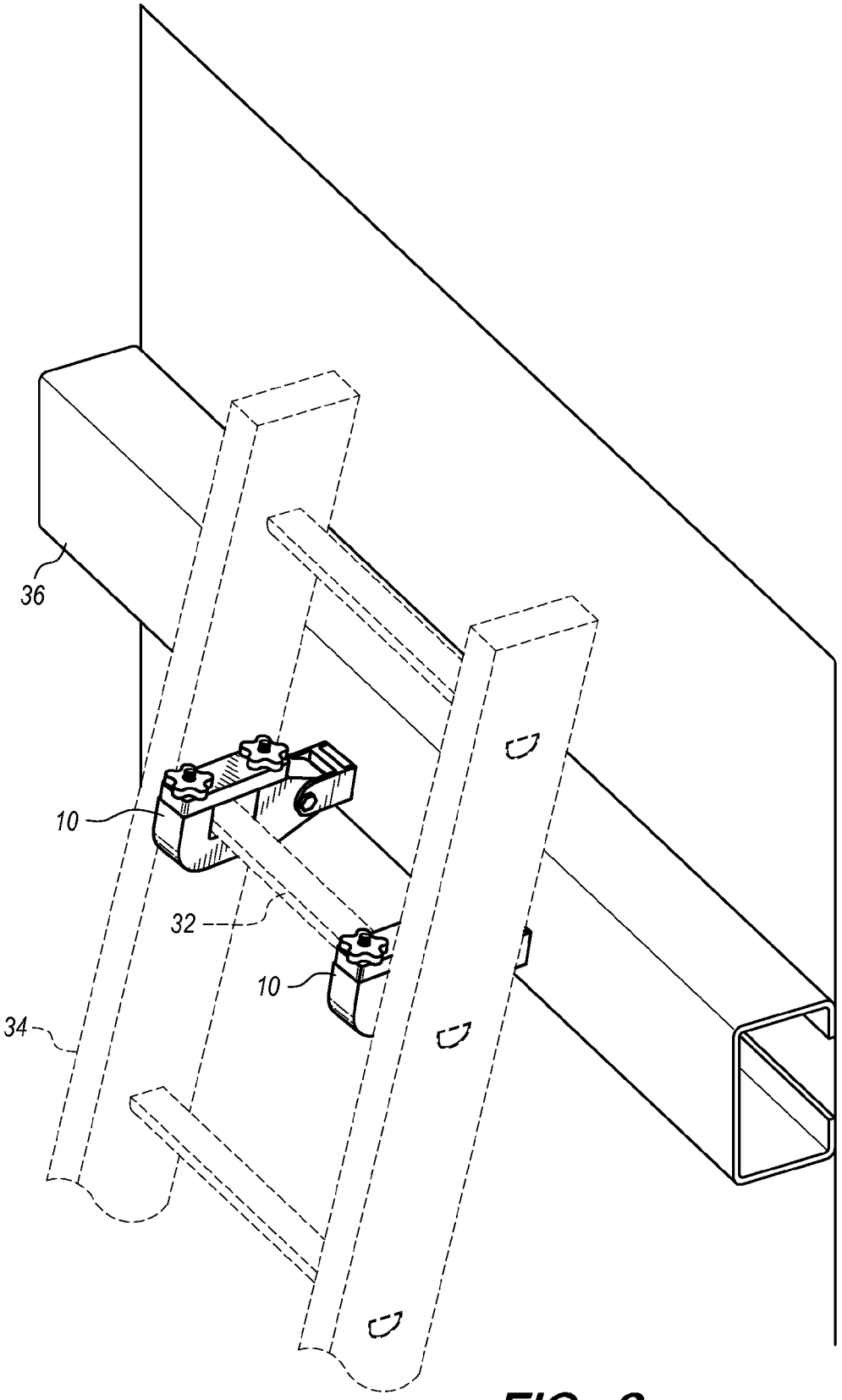
FIG. 3 is a drawing depicting the use of preferred embodiments of the invention in connection with a leaning-type ladder employed during construction, inspection, or maintenance performed at a ferromagnetic surface such as a metal beam.

With reference to FIGS. 1 and 2, a bracket clamping assembly according to a preferred embodiment of the present invention may be described. As illustrated in FIG. 3, two such bracket clamping assemblies are used to secure a ladder 34 to a beam 36 or other ferromagnetic surface.

Each bracket clamping assembly is formed of a bracket 10, a clamping bar 14, a magnet mount 20, and a magnet 22. Bracket 10 and clamping bar 14 are snugly fittable around a rung 32 of a ladder 34, thereby forming rung space 30 between bracket 10 and clamping bar 14 due to the generally C-shaped design of bracket 10. Clamping bar 14 is held in place against bracket 10 by two threaded rods 16 and two clamping bar nuts 17. Threaded rods 16 are threaded into bracket 10, such as by use of a tap, so that they are securely connected into bracket 10. Clamping bar nuts 17 are preferably of the type that feature large, easy-to-grip head attachments in order to allow for hand-tightening and hand-loosening of clamping bar nuts 17 by a worker.

Bracket 10 is connected to magnet mount 20 at extending lip 12 of bracket 10 by means of magnet bolt 24 and magnet nut 26. Magnet assembly wings 18 are aligned with extending lip 12 such that magnet bolt 24 may pass through both magnet assembly wings 18 and extending lip 12 with extending lip 12 between the two magnet assembly wings 18. Magnet nut 26 secures magnet bolt 24 in place, thereby securing magnet assembly 20 to bracket 10 at the appropriate angle in order to maintain the desired 4-to-1 ratio of ladder 34 during use. By loosening and re-tightening magnet bolt 24, the angle of the face of magnet 22 in magnet assembly 20 may be adjusted with respect to the angle of bracket 10, and thus, when the device is attached to a rung 32, with respect to the angle of ladder 34. Furthermore, slot 21 in bracket 10, through which magnet bolt 24 passes, is elongated such that further adjustment between bracket 10 and magnet mount 20 may be performed by moving magnet bolt 24 either upward or downward in slot 21, as desired, while magnet nut 26 is loosened. In this way, the device may be adjusted in such a manner as to provide the desired 4:1 ratio that maximizes the safety of a worker using ladder 34 regardless of the length of ladder 34 or the rung 32 upon which the device is placed for use, and further such that a secure connection is made against beam 36 with the face of magnet 22 fully engaging with beam 36.

Magnet 22 is preferably a permanent magnet formed of a "hard" ferromagnetic material, such as alnico or hard ferrites. It is aligned on magnet mount 20 such that it provides a magnetic attraction towards a nearby ferromagnetic support, such as beam 36 as shown in FIG. 3. In one embodiment, an alnico permanent magnet with about a 70 lb. effective pull is employed, although various other types of magnets as are known in the art may be substituted in alternative embodiments.

Bracket 10, clamping bar 14, and magnet mount 20 are preferably formed of aluminum or steel or another sufficiently rigid metal to provide a secure hold for ladder 34 without breaking during use. In alternative embodiments, other materials could be used, such as a resin of sufficient strength.

The structure of certain embodiments having been described, a method of using the bracket clamping assemblies in order to hold a ladder 34 safely in place may be described with reference to FIG. 3. In this example, a worker desires to reach a high area on the inside wall of a building with an exposed metal beam 36, such as for construction, painting, maintenance, or other reasons. In order to do so, the worker employs ladder 34 to reach the desired height. Two of the bracket clamping assemblies, as shown individually in FIGS. 1 and 2, are employed to hold a rung 32 of ladder 34 in place once ladder 34 is leaned into place adjacent to ferromagnetic steel beam 36.

In order to connect the two bracket connecting assemblies to rung 32 of ladder 34, clamping bar nuts 17 are first loosened and removed. This allows the worker to place each bracket 10 under the appropriate rung 32 such that rung 32 is aligned within rung space 30. Each clamping bar 14 is then positioned in alignment with each bracket 10 in turn, and clamping bar nuts 17 are positioned on threaded rods 16 and tightened to hold the bracket clamping assemblies securely in place.

Preferably, both brackets 10 are positioned at points on the same rung 32 of ladder 34, directly across from each other. It may be seen, however, that uneven placement of brackets 10 may be desirable if an uneven work support were lying underneath ladder 34. Since the brackets 10 are movable to any location and any rung 32 of ladder 34, the preferred embodiment allows the worker to compensate for this occurrence and still provide a safely secured position for ladder 34.

Once ladder 34 is positioned with magnets 22 making contact with beam 36, it may be seen that ladder 34 will be held safely in position with its top such that the worker may climb the ladder and work from the ladder without the risk of ladder 34 slipping during use. The worker is protected from the first moment he or she beings to climb ladder 34. Once the work at a particular location is completed, the worker may climb down ladder 34 and, with a simple twisting motion of ladder 34, disengage first one then another of magnets 22 from beam 36. By using the top of ladder 34 against the surface as a fulcrum and ladder 34 as the lever, the worker is able to apply sufficient leverage to overcome the magnetic attraction of magnets 22 to beam 36, and thereby move ladder 34.

As used herein, "comprising" is synonymous with "including," "containing," or "characterized by," and is inclusive or open-ended and does not exclude additional, unrecited elements or method steps. As used herein, "consisting of" excludes any element, step, or ingredients not specified in the claim element. As used herein, "consisting essentially of" does not exclude materials or steps that do not materially affect the basic and novel characteristics of the claim. When a grouping is used herein, all individual members of the group and all combinations and subcombinations possible of the group are intended to be individually included in the disclosure. When a range is expressed herein, all values within and subsets of that range are intended to be included in the disclosure.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Thus, additional embodiments are within the scope of the invention and within the following claims. In general the terms and phrases used herein have their art-recognized meaning, which can be found by reference to standard texts, journal references and contexts known to those skilled in the art. The preceding definitions are provided to clarify their specific use in the context of the invention.

The present invention has been described with reference to certain preferred and alternative embodiments that are intended to be exemplary only and not limiting to the full scope of the present invention as set forth in the appended claims.

The invention claimed is:

1. A ladder stabilizing apparatus for attachment to a rung of the ladder in order to secure the ladder in place to a ferromagnetic support, the ladder stabilizing apparatus comprising:

a. a bracket, wherein the bracket is C-shaped and comprises an opening and an extending lip, and wherein the lip comprises a vertically-aligned elongated slot;

b. a flat-shaped clamping bar fitted over the bracket and the opening thereby closing the opening and creating a rung space in the opening between the clamping bar and the bracket the rung space shaped and sized to securely receive the ladder rung; therein c. a magnet mount comprising a pair of magnet mount wings, wherein the extending lip of the bracket mount is fitted between the magnet mount wings;

d. a magnet bolt passing through each of the magnet mount wings and the vertically-aligned elongated slot of the extending lip of the bracket thereby pivotally attaching the bracket to the magnet mount;

e. a magnet attached to the magnet mount opposite the bracket, wherein the magnet mount wings extend forwardly to be flush with a front face of the magnet; and f. a pair of threaded rods a respective one of said pair of threaded rods is threaded into opposite sides of the opening in the bracket and passing through the clamping bar to removably fasten the clamping bar to the bracket;

wherein the extending lip of the bracket is of such length and angled such that when the ladder stabilizing apparatus is attached to the rung of the ladder and positioned in place adjacent the ferromagnetic support, the bracket may be adjusted such that the ladder maintains about a 4:1 ratio between a working length of the ladder and a horizontal distance from a top support to a foot of the ladder.

2. The apparatus of claim 1, further comprising a pair of clamping bar nuts each attachable to one of the pair of threaded rods, wherein each of the clamping bar nuts comprises an easy-to-grip head to facilitate hand loosening and tightening.

3. The apparatus of claim 1, wherein the magnet comprises a hard ferromagnetic material.

4. The apparatus of claim 3, wherein the magnet comprises alnico.

* * * * *